United States Patent [19]

Hockly

[11] 3,956,777

[45] May 18, 1976

[54] CISTERN BALL COCK CONTROL DEVICE

[76] Inventor: Leonard David Hockly, 57 Hinewa Road, Tauranga, New Zealand

[22] Filed: July 15, 1974

[21] Appl. No.: 488,725

[30] Foreign Application Priority Data

| | | |
|---|---|---|
| July 18, 1973 | New Zealand | 171,409 |
| July 26, 1973 | New Zealand | 171,497 |
| Nov. 7, 1973 | New Zealand | 172,502 |

[52] U.S. Cl. ..... 4/67 A; 137/426

[51] Int. Cl.[2] ..... E03D 1/14

[58] Field of Search ..... 4/34, 37, 41, 44, 52, 4/56, 57 P, 67 R, 67 A, 249; 137/445, 451, 426

[56] References Cited

UNITED STATES PATENTS

| | | | |
|---|---|---|---|
| 1,382,027 | 6/1921 | Sweeny | 137/445 X |
| 1,984,394 | 12/1934 | Cardee | 4/44 |
| 2,346,543 | 4/1944 | Peterson et al. | 137/445 |
| 2,803,833 | 8/1957 | Charest | 4/34 |
| 3,239,847 | 3/1966 | Parri | 4/41 X |
| 3,609,770 | 10/1971 | Heyer et al. | 4/41 |
| 3,777,316 | 12/1973 | Coetzee | 4/34 |

*Primary Examiner*—Richard E. Aegerter
*Assistant Examiner*—Stuart S. Levy
*Attorney, Agent, or Firm*—Harness, Dickey & Pierce

[57] ABSTRACT

A cistern flush mechanism providing dual volumetric displacement. The mechanism comprises a ball cock actuating arm pivotally carrying adjacent its free end a depending float arm, a spacer pivotally carried by one of said arms and movable between a first position interposed between said arms to close the ball cock after a lower volumetric flow, and a second position permitting a higher volumetric flow, and means for moving said spacer from its first to its second positions.

9 Claims, 5 Drawing Figures

CISTERN BALL COCK CONTROL DEVICE

This invention relates to manually operated flush cisterns and is particularly concerned with providing a device for controlling the input and thus the output of such a cistern.

Known manually operated flush cisterns provide a discharge substantially volumetrically constant for each operation thereof. At least some authorative people and organizations now regard this as wasteful and uneconomical and that, in some operations, a discharge less than that normally now provided to be adequate to achieve desirable standards of hygiene.

The intention of this invention is to provide a device to control the input to a manually operated flush cistern to two distinct stages and thereby provide a corresponding control of the output or discharge from the cistern, the cistern thus being adapted to provide a dual volumetric discharge whereby a discharge quantity, being either a larger or lesser amount, will be discharged in accordance with the operation of the controls, thereby enabling water to be saved.

According to one aspect of this invention there is provided a cistern ball cock control device comprising an arm ("the actuating arm") adapted at one end for mounting to a ball cock as an actuating arm therefor and being pivotally connected adjacent its other end to an intermediate position of a second arm ("the float arm") disposed in the same plane as the actuating arm, one section of the float arm, considered as divided into two sections at the intermediate position thereof at which it is pivotally connected to the actuating arm, being adapted to support a float, a spacer mounted to either the actuating arm or the non-float support section of the float arm, the mounting of the spacer enabling movement of the spacer between two positions, one position being that where the spacer is interposed between the actuating arm and the non-float support section of the float arm such that the actuating arm and the float support section of the float arm are disposed in a dog-leg formation, the spacer being influenced to tend to take-up this interposed position, the other position being that where the spacer is clear of that interposed position, and an operating member adapted for mounting in situ, the spacer to be displaced clear of the interposed position.

Figure 1:
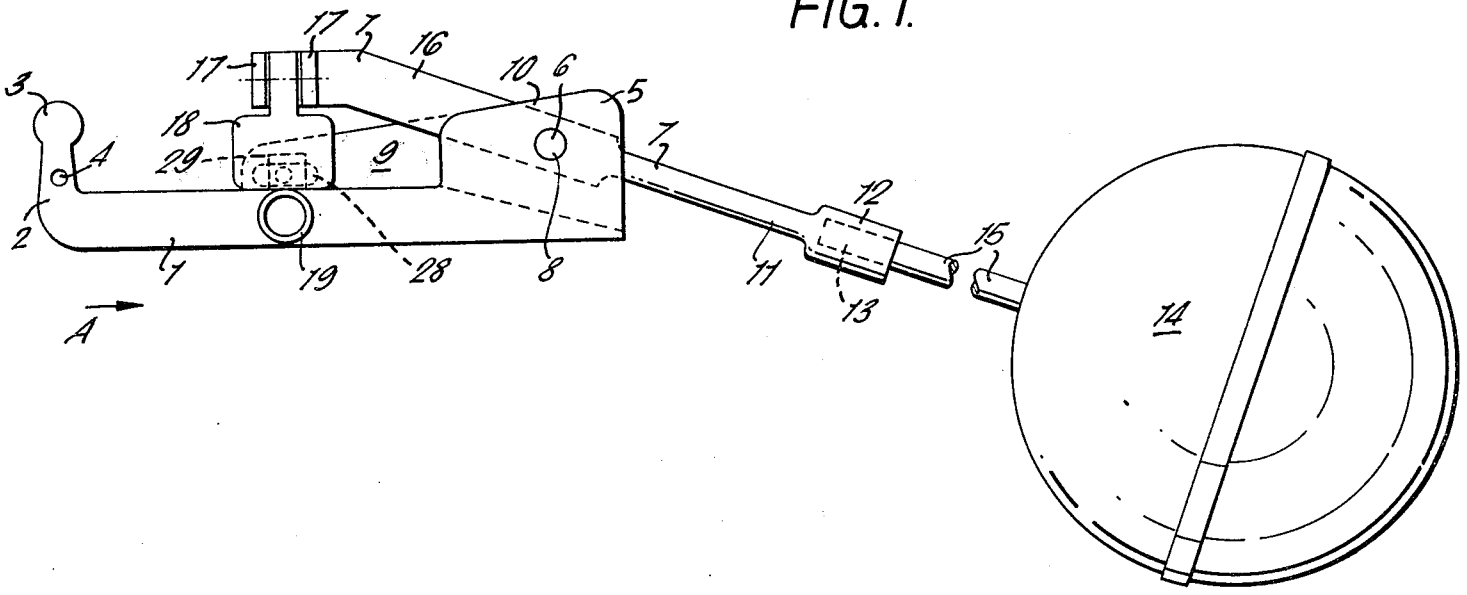
Figure 3:
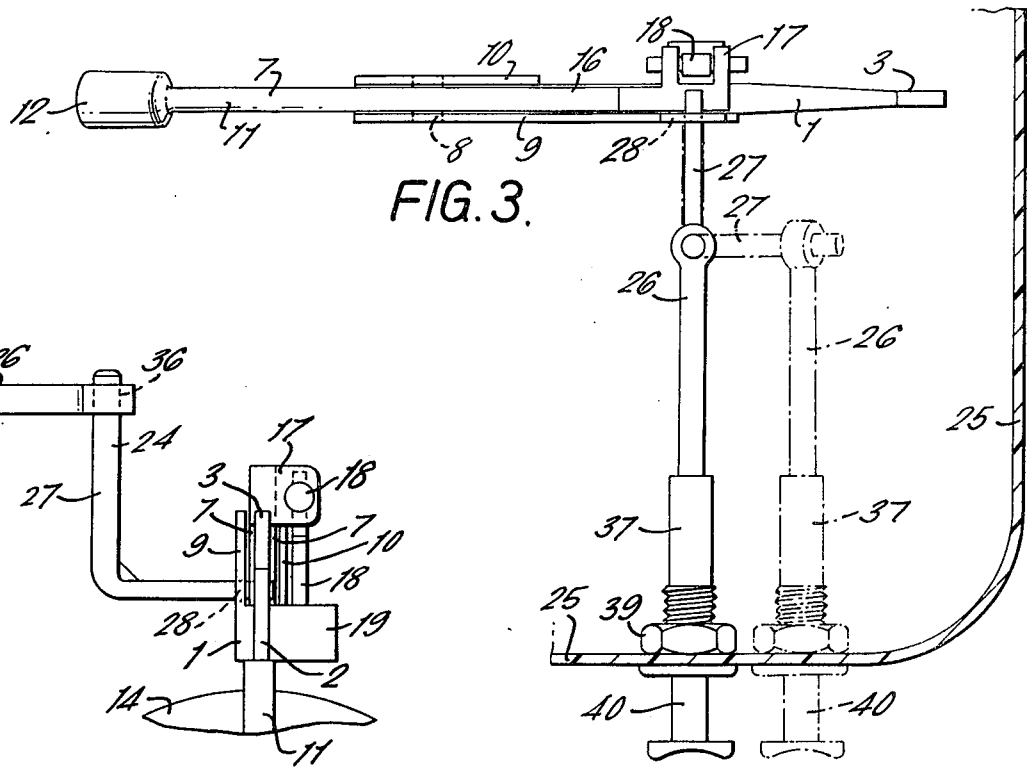
Figure 2:
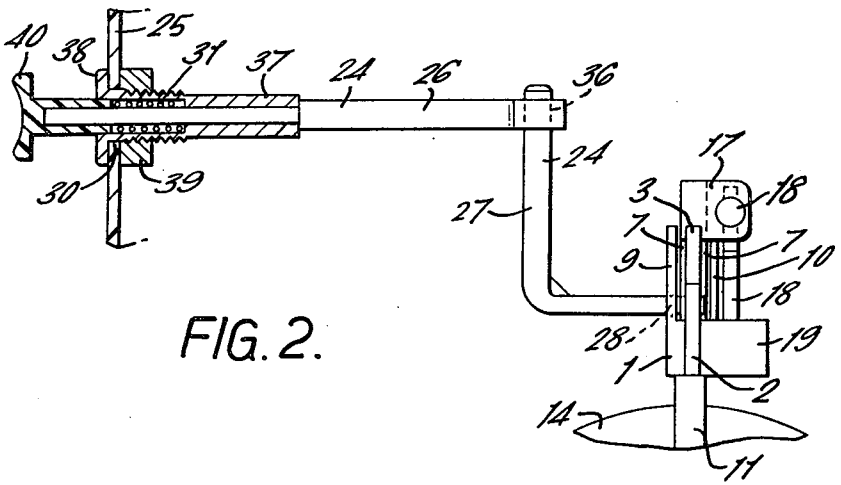
Figure 4:
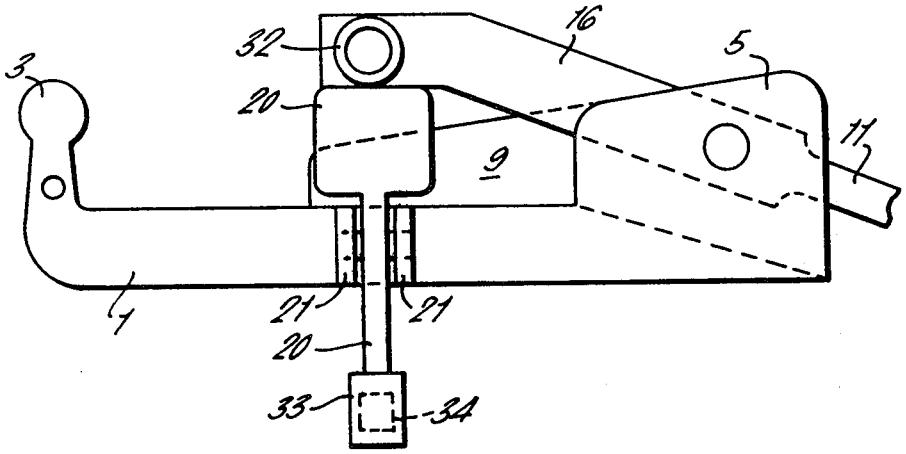
Figure 5:
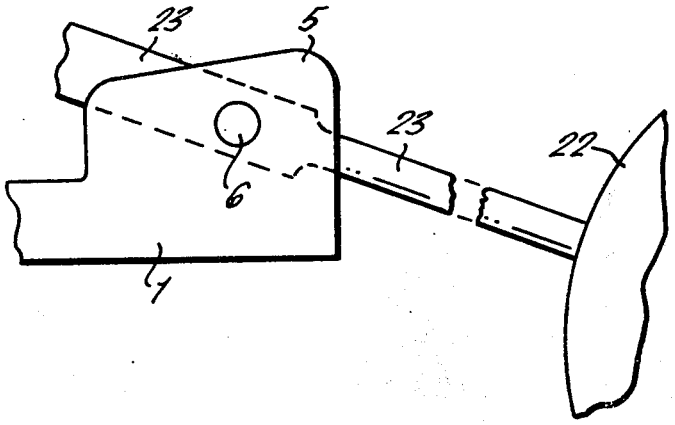

In further describing the invention reference is made to the accompanying drawings wherein:

FIG. 1 is a side elevation, depicted spatially, of the device, and for clarity an operating member therefore has been omitted, and FIG. 2 is a truncated end view, in the direction of Arrow A on FIG. 1, depicting the device mounted in a cistern, and FIG. 3 is a plan view of FIG. 2, for simplicity a float and its adjunct arm not being fitted to the device and having depicted thereon, in phantom, an alternative positioning of the operating member, and FIG. 4 is partial side elevation similar to FIG. 1, depicting an alternative form of the device, and FIG. 5 is a partial side elevation similar to FIG. 1 depicting yet a further form of the invention.

The elements of the device are preferably moulded from an acetal plastics material. A first arm ("hereinafter the actuating arm 1") incorporates an upstanding portion 2 at one end thereof. The free end of portion 2 is adpated, such as by enlargement 3 and aperture 4, to be mounted to a ball cock (not shown) or similar cistern control valve, such that arm 1 forms an actuating arm therefor. In the preferred form actuating arm 1 is retained to a ball cock by a pin passing through aperture 4 and the body of the ball cock with enlargement 3 coacting with the working mechanism of the ball cock.

At the opposing end of actuating arm 1 a bifurcated upstanding portion 5 is formed, the sections of portion 5 being disposed parallel to and laterally of the longitudinal axis of actuating arm 1. One section 9 of portion 5 extends for approximately half the length of actuating arm 1 and the other section 10 extends for approximately one quarter of the length of actuating arm 1. Aligned apertures 6 are formed in the sections 9, 10 adjacent to the end of actuating arm 1 enabling a second arm (hereinafter the float arm 7) to be pivotally connected to actuating arm 1 to reside in the same plane thereas.

Float arm 7 is formed with two opposingly positioned and laterally extending stub axial type projections 8 intermediately, preferably medially, along its length. The arrangement provides that sections 9, 10 can be temporarily influenced apart and arm 7 positioned therebetween to enter projections 8 in apertures 6 to pivotally connect actuating arm 1 and float arm 7 together. For ease of description float arm 7 is considered as divided into two sections at this intermediate position of projections 8.

A section 11 of float arm 7 extends beyond actuating arm 1 and is adapted, such as by providing an enlarged portion 12 formed in its end with an axially disposed blind hole 13, to support a float 14. Hole 13 is dimensioned to provide a push fit for the end of an arm 15 fitted to a float 14. In this manner a float and adjunct arm, such as float 14 and arm 15, of an existing conventional cistern float arm can be utilized should such a unit be replaced by this device, the arm being cut and may be bent to facilitate fitting of the device in the cistern.

It will be appreciated that the device could well be manufactured with a float as an integral part thereof (described in detail hereinafter) but it is intended that the device be utilized either as described above as a replacement unit, or, where it is to be incorporated in a new cistern, for a float and an adjunct arm to be supplied as a detached part with the arm on the float formed from a pliable metal element, such as a brass-rod or copper tube, which can readily be cut, bent and otherwise fitted in situ.

The remaining section 16, being the non-float section, of float arm 7 extends part-way over actuating arm 1. The free end of section 16 is preferably inclined toward actuating arm 1 and a pair of spaced apart lateral lugs 17 are formed adjacent this free end, the lugs 17 being directed toward the side of actuating arm 1 on which section 10 of portion 5 is formed.

A spacer 18 is pivotally attached between lugs 17 in similar manner to the pivotal connection described above between actuating arm 1 and float arm 7. Spacer 18 is formed within an enlarged section at its free end, this enlarged section preferably being weighted, such as by a metal insert 29, moulded therein, such that under the influence of gravity spacer 18 tends to depend downwardly of lugs 17 as to be interposed between section 16 and actuating arm 1. In the preferred form, a lateral projection 19 is formed on the side of actuating arm 1, projection 19 being correspondingly directed to lugs 17 and disposed opposite but lower to the adjacent end of section 9. Lugs 17 extend a sufficient distance to position spacer 18 such that it depends onto projection 19.

An operating member 24 is provided to be mounted, in situ, through the casing 25 of a cistern whereby actuation of operating member 24 will displce spacer 18 from its interpoed position, described above, enabling actuating arm 1 and float arm 7 to tend to align as described in more detail hereinafter.

Operating member 24 preferably comprises two elements. A first straight rod like element 26 is slidably mounted in a cylindrical externally threaded sleeve 37 incorporating an end flange 38 and mounted by way of a nut 39, in an aperture 30, which need not be sealed, formed in casing 25. Element 26 has a push control button 40 mounted thereon as to be positioned externally of casing 25 and is spring loaded as at 31, outwardly of casing 25. A second element 27 is of rod form and longitudinally L shaped. In situ, one end of element 27 extends generally upwardly and is friction fitted in a transversely disposed aperture 36 provided in the inner end of element 26. The other end of element 27 is positioned in an aperture, preferably a slot 28, formed adjacent to the inner end of section 9 on actuating arm 1, the end of element 27 being positioned adjacent and laterally of the free end of spacer 18.

By this arrangement, aperture 30 can be positioned clear of the expected water level within the cistern and only limited care is necessary in positioning it relative to actuating arm 1. More particularly, the fit of element 27 in element 26 and rotary adjustment of element 26 within its mounting enables height adjustment and lateral adjustment respectively between the aperture 30 and slot 28, the lateral adjustment being indicated in phantom on FIG. 3.

In situ, actuating arm 1 is fitted to a ball cock as described above. Arm 15 is then fitted by cutting and bending to the required size and shape to fit the particular cistern. The free end of arm 15 is then fitted into hole 13 of float arm 7. Operating member 14 is mounted as aforesaid, an aperture 30 being drilled in casing 25, and elements 26, 27 adjusted relative to one another and the mounting aperture 30 to correctly position operating member 24 relative to actuating arm 1.

In operation, the influence of the water in the cistern upon the float will pivot arm 7 about actuating arm 1 until spacer 18 is impinged between actuating arm 1 and section 16 of float arm 7 "interlocking" the mechanism in this dog-leg formation such that thereafter actuating arm 1 will also rise with float 14 to close the ball cock. This is a first-state of the device, this stage being depicted in FIG. 1.

Should additional storage be required, operating member 24 is momentarily pushed against its spring influence and the end of element 27 within slot 28 will dislodge spacer 18 clear of the end of projection 19, thus removing the "interlock" of the mechanism. With spacer 18 so dislodged the free end of actuating arm 1 rapidly lowers a limited amount under the weight of the float and under the influence of the water pressure controlled by the ball cock. This lowering action tends to align actuating arm 1 and float arm 7 preventing return of the spacer 18 and opens the ball cock. With a rise in the water level float arm 7 will tend to pivot about actuating arm 1 until the free end of section 16 of float arm 7 impinges upon actuating arm 1 to again "interlock" the device. This is the second-state of the device, being that where the spacer 18 is clear of its first-state interposed position. Actuating arm 1 will then rise with float 14 to result in the eventual close of the ball cock with the water at a higher level than at which it was at the first-state of the device.

Upon flushing, float 14 and thus float arm 7 will lower as will be the tendency of actuating arm 1, the lowering of the latter being limited by its mounting to the ball cock. At that stage, float arm 7 will tend to pivot about actuating arm 1 raising the free end of section 16 clear of actuating arm 1 such that the spacer 18 can take up its depending position and upon the water level rising, the first-state of the device, as depicted in FIG. 1, results.

The action of the device following a "full" or a "half" flush, is the same in both cases, the device taking up its first-state thereafter. If a "full" flush is required, then beforehand operating member 24 is actuated to release the device from its first-state enabling it to take up its second-state prior to flushing.

In a modified form of the invention, depicted in FIG. 4, a spacer 20 may be pivoted to lugs 21 formed on actuating arm 1, in the place of projection 19 on the preferred form and correspondingly a projection 32 formed in the place of lugs 17 on the preferred form. Spacer 20 is formed with a depending tail 33, preferably weighted as at 34, such that upon spacer 20 being dislodged in the same manner as in the preferred form, tail 33 will tend to return spacer 18 to its interposed position thereby achieving a similar result to spacer 18 in the preferred form. For this purpose, the pivotal axis of spacer 20 will be displaced far enough from arm 1 to permit sufficient dislodgement of spacer 20 so that float arm section 16 may impinge upon actuating arm 1 to "interlock" the device when additional storage is required, as in the previous embodiment.

As mentioned above the device, excluding arm 15 where provided as a detached part, is preferably formed from a acetal plastics material as this material has a degree of water absorption which will facilitate the joints between the float arm 7 and arm 15 and elements 26 and 27 of operating member 24.

Referring to FIG. 5, in a further modified form of the invention, mentioned briefly above, a float arm 23 can include a float 22 as an integral part thereof. Float arm 21 is pivotally connected to actuating arm 1 in similar manner to the preferred form of the invention, and is preferably made of brass rod, copper tube or other readily pliable material to facilitate fitting in a cistern. Either the spacer 18 or spacer 20 arrangement can be used with this form of the invention.

What I claim is:

1. A cistern ball cock control device comprising an arm adapted at one end for mounting to a ball cock as an actuating arm therefor, a second arm disposed in the same plane as said actuating arm, the actuating arm being pivotally connected adjacent its other end to an intermediate position of said second arm, one section of the float arm, considered as divided into two sections at the intermediate position thereof at which it is pivotally connected to the actuating arm, being adapted to support a float, the other section of the float arm being a non-float support section, a spacer movably mounted to one of said arms, the movable mounting of the spacer enabling movement of the spacer between two positions, one position being that where the spacer is interposed between the actuating arm and the non-float support section of the float arm such that the actuating arm and the float support section of the float arm are disposed in a non-aligned formation, means urging the spacer to tend to take-up this interposed position, the other position being that where the spacer extends laterally with respect to said plane and therefore is clear of that interposed position, and an operating member, and means for mounting said operating member in a cistern so as to extend through the cistern casing toward said spacer to enable, when the device is mounted in situ, the spacer to be displaced clear of the interposed position.

2. A cistern ball cock control device as claimed in claim 1 wherein the float support section of the float arm is adapted to retain the free end of a float retaining arm.

3. A cistern ball cock device as claimed in claim 1 wherein the float arm includes a float as an integral part thereof, the float arm being formed from a readily pliable material.

4. A cistern ball cock device as claimed in claim 1 wherein the operating member is comprised of two elements, one element being adapted for mounting through an aperture in the cistern's casing to be slidably operative therethrough, and the other element being longitudinally L-shaped, an aperture formed in an upstanding portion of the actuating arm adjacent and laterally of the interposed position of the spacer, one end of said L-shaped element being mounted in said aperture, and a transversely disposed aperture provided adjacent the inner end of the first element, the other end of said L-shaped element frictionally fitting into said last-mentioned aperture.

5. A cistern ball cock control device as claimed in claim 1, said non-float section of the float arm having a free end, wherein the spacer is mounted between a pair of lugs formed laterally of and adjacent the free end of the non-flaot section of the float arm, whereby, in situ, the spacer tends to depend downwardly of the lugs to take-up its interposed position, a projection being formed on the actuating arm extending laterally in the same direction as said lugs, and the lugs positioning the spacer such that it depends onto the projection.

6. A cistern ball cock device as claimed in claim 5, said spacer having a free end, said end being weighted.

7. A cistern ball cock control device as claimed in claim 1, wherein the spacer is pivotally attached between a pair of laterally positioned lugs formed on the actuating arm, the spacer incorporating a downwardly depending tail section, the non-float section of the float arm having a free end, a projection being formed adjacent the free end of the non-float section of the float arm extending laterally in the same direction as said lugs such that the spacer tends to interpose itself between its mounting lugs and the projection.

8. A cistern ball cock device as claimed in claim 7 wherein the tail section of the spacer is weighted.

9. A cistern ball cock control device as claimed in claim 1 wherein the actuating arm is formed with a bifurcated upstanding portion at that end thereof which is pivotally connected to the float arm, the sections of the bifurcated portion being disposed parallel to and laterally of the longitudinal axis of the actuating arm and aligned apertures being formed in these sections, the float arm being formed with two opposingly positioned and laterally extending stub axial type projections intermediate of its length whereby the sections of the actuating arm can be temporarily influenced apart and the float arm positioned therebetween to home the projections within the apertures to pivotally connect the actuating arm to the float arm.

* * * * *